US005296875A

United States Patent [19]

Suda

[11] Patent Number: 5,296,875

[45] Date of Patent: Mar. 22, 1994

[54] INK JET RECORDING HEAD HAVING IMPROVED FILTER SYSTEM AND RECORDING APPARATUS USING SAME

[75] Inventor: Masashi Suda, Iruma, Japan

[73] Assignee: Canon Kabushiki Kaisha, Tokyo, Japan

[21] Appl. No.: 968,467

[22] Filed: Oct. 29, 1992

Related U.S. Application Data

[63] Continuation of Ser. No. 668,240, Mar. 12, 1991, abandoned.

[30] Foreign Application Priority Data

Mar. 19, 1990 [JP] Japan ..... 2-67288

[51] Int. Cl.[5] ..... B41J 2/18

[52] U.S. Cl. ..... 346/140 R

[58] Field of Search ..... 346/140 R, 75; 400/126

[56] References Cited

U.S. PATENT DOCUMENTS

| | | | |
|---|---|---|---|
| 3,708,118 | 1/1973 | Keur | 239/1 |
| 4,007,465 | 2/1977 | Chaudhary | 346/140 R |
| 4,153,902 | 5/1979 | Kanayama | 346/140 R |
| 4,313,124 | 1/1982 | Hara | 346/140 R |
| 4,345,262 | 8/1982 | Shirato et al. | 346/140 R |
| 4,346,388 | 8/1982 | Wiley | 346/75 |
| 4,403,227 | 9/1983 | Bertschy et al. | 346/75 |
| 4,459,600 | 7/1984 | Sato et al. | 346/140 R |
| 4,460,904 | 7/1984 | Oszczakiewics et al. | 346/75 |
| 4,463,359 | 7/1984 | Ayata et al. | 346/1.1 |
| 4,558,333 | 12/1985 | Sugitani et al. | 346/140 R |
| 4,658,268 | 4/1987 | Needham | 346/1.1 |
| 4,723,129 | 2/1988 | Endo et al. | 346/1.1 |
| 4,947,191 | 8/1990 | Nozawa et al. | 346/140 R |

FOREIGN PATENT DOCUMENTS

| | | |
|---|---|---|
| 54-056847 | 5/1979 | Japan . |
| 59-123670 | 7/1984 | Japan . |
| 59-138461 | 8/1984 | Japan . |
| 60-071260 | 4/1985 | Japan . |

*Primary Examiner*—Benjamin R. Fuller
*Assistant Examiner*—N. Le
*Attorney, Agent, or Firm*—Fitzpatrick, Cella, Harper & Scinto

[57] ABSTRACT

An ink jet recording apparatus that records on a recording medium by discharging ink from a discharge outlet contained in an ink jet recording head including an ink housing section in which ink is stored, a first filter disposed in a first ink path for supplying ink used for recording to the ink jet recording head from the ink housing section and a second filter disposed in a second ink path for supplying ink to the ink jet recording head from the ink housing section for recovering operation of the head. The size $D_I$ of the opening of the first filter, the size $D_O$ of the opening of the second filter and the minimum diameter $D_H$ of the head nozzle have the relationship of $D_I<D_O<D_H$.

13 Claims, 5 Drawing Sheets

INK JET RECORDING HEAD HAVING IMPROVED FILTER SYSTEM AND RECORDING APPARATUS USING SAME

This application is a continuation of application Ser. No. 07/668,240 filed Mar. 12, 1991, now abandoned.

BACKGROUND OF THE INVENTION

1. Field of the Invention

The present invention relates to an ink jet recording head that records on a recording medium by discharging ink and, more particularly, to an improved ink filtering system for such a recording head.

2. Description of the Related Art

In a conventional ink jet recording apparatus, in particular an apparatus that uses a permanent type ink jet recording head, the obstruction of the nozzle of the head with dirt or dust can shorten the life of the apparatus. Hence, to prevent dirt from mixing in an ink path of such an apparatus, a filter is inserted into an ink circulation system.

FIG. 7 shows the ink circulation system of this type of ink jet recording apparatus.

When the ink in a subtank ink housing 421 runs low, the ink drops from an ink cartridge 420 by gravity in order to make up the loss. A gap is provided where the subtank 421 and the ink cartridge 420 are fitted together. The interior of the subtank 421 is in communication with atmosphere by means of the gap. When ink drops from the ink cartridge 420 to the subtank 421, a volume of air equal to the amount of ink that has dropped enters from the subtank 421 to the ink cartridge 420.

At this point, prior to the use of an ink jet recording head 410, a recovery operation is performed for evacuating air present in the ink path of the apparatus and for circulating ink in the liquid chamber 411 of the ink jet recording head 410, the latter because the viscosity of the ink may have increased so the ink differs from its original quality. The recovery operation is performed such that the ink in the subtank 421 is supplied to the liquid chamber 411 by means of a gear pump 431 and a lower tube 440, by rotating a motor 430 to operate the gear pump 431. The ink is returned to the subtank 421 again by way of an upper tube 441. Some of the ink supplied to the liquid chamber 411 during a recovery operation may ooze out of some of the head nozzles 412, and any such ink is absorbed by a liquid absorbing agent 413 disposed below the head nozzles 412. At this time, it is effective to blow air from the head nozzles 412 so as to make easy the oozing out of ink to be dropped. As a result, the ink whose viscosity is increased in the head nozzles 412 is discarded and any dirt or debris present on the surface of the head is washed away.

In order for the recovery operation to function reliably, the gear pump 431 feeds ink at a high pressure of a lift of about 5 m and at a flow rate of about 1 cc/sec. Hence, there is a possibility that dirt in the subtank 421 and abrasive particles from in the gear pump 431 are fed by pressure into the liquid chamber 411 of the ink jet recording head 410.

The ink fed to the ink jet recording head 410 during recording is supplied from the subtank 421 by the upper tube 441. A small amount of ink may also be supplied through the lower tube 440 because of leakage through the gear pump 431, even though it is stopped. The ink at this time is approximately at atmospheric pressure (a lift of approximately 0.1 m) and its flow rate is 0.01 cc/sec or smaller. Therefore, the probability is small that dirt entrained in the ink is fed by pressure into the liquid chamber 411 through a first filter 414 and a second filter 415 which are disposed at the junctions of the ink jet recording head 410 and the lower tube 440 and the upper tube 441, respectively.

However, since the size of the openings of the first filter 414 is equal to the size of the openings of the second filter 415, and the two opening sizes are smaller than the minimum diameter of the head nozzles 412, this prior art apparatus can still be subject to clogging of the nozzles, because the shape of the dirt is not necessarily in the form of particles, but there also may be dirt present in the form of strings or filaments. Thus, even if the size of the openings of the nozzles 412 is greater than the size of the openings of the first filter 414, the nozzles 412 could be obstructed if dirt in the form of filaments, or filaments tangled with dirt particles, enter the nozzle 412.

SUMMARY OF THE INVENTION

An object of the present invention is to provide an ink jet recording head with an increased life.

Another object of the present invention is to provide an ink jet recording apparatus in which the problem of the non-discharged ink of the ink jet recording head is solved, thus improving reliability.

A further object of the present invention is to provide an ink jet recording head in which the problem of obstruction of the recording nozzles is solved so that the probability such an obstruction occurring is minimized.

A still further object of the present invention is to provide an ink jet recording apparatus having an ink circulation system with filters that prevent the nozzle of an ink jet recording head in the apparatus from being obstructed with dirt.

In accordance with one aspect of the present invention, an ink jet recording head comprises a nozzle for discharging ink onto a recording medium, a liquid chamber for holding ink to be discharged from the nozzle, a first filter disposed in a first flow path in communication with the liquid chamber, the first filter having openings for ink flowing in the first flow path to the liquid chamber for recovering operation of the recording head, and a second filter disposed in a second flow path in communication with the liquid chamber, the second filter having filter openings for ink flowing in the second flow path to the liquid chamber for discharge from the nozzle onto the recording medium, wherein the size $D_I$ of the openings of the first filter, the size $D_O$ of the openings of the second filter, and the minimum diameter $D_H$ of the nozzle, have the relationship $D_I<D_O<D_H$.

In accordance with another aspect of the present invention, an ink jet recording apparatus, for recording on a recording medium by discharging ink from a discharge nozzle of an ink jet recording head, comprises an ink housing for storing ink, a first ink path communicating with ink housing and the ink jet recording head to supply ink to the recording head for recovering operation thereof, a first filter disposed in the first ink path and having filter openings for ink flowing in the first ink path, a second ink path communicating with the ink housing and the ink jet recording head to supply ink to the recording head for discharge from the nozzle for recording, and a second filter disposed in the second ink path and having filter openings for ink flowing in the second ink path, wherein the size $D_I$ of the openings of the first filter, the size $D_O$ of the openings of the second filter, and the minimum diameter $D_H$ of the nozzle, have the relationship $D_I<D_O<D_H$.

These and other objects, features and advantages of the present invention will become clear when reference is made to the following description of the preferred embodiments of the present invention, together with reference to the accompanying drawings.

DESCRIPTION OF THE PREFERRED EMBODIMENTS

The embodiments of the present invention will be explained below with reference to the accompanying drawings.

The ink jet recording apparatus of the present invention is capable of preventing dirt from staying for a long period of time in a liquid chamber since the size $D_I$ of the openings of the first filter disposed at any position in a first ink path which supplies ink to the ink jet recording head during a recovery operation is set smaller than the size $D_O$ of the openings of a second filter disposed at any position in a second ink path which supplies ink to the ink jet recording head during recording This makes it difficult for dirt to enter the liquid chamber and any dirt which does enter the liquid chamber goes out of the liquid chamber by being permitted to pass through the second filter. The ink jet recording apparatus is also capable of preventing dirt from staying for a long period of time in the liquid chamber, because dirt which enters the liquid chamber is discharged from a head nozzle whose minimum diameter $D_H$ is larger than the size $D_I$ of the openings of the first filter.

Figure 1:
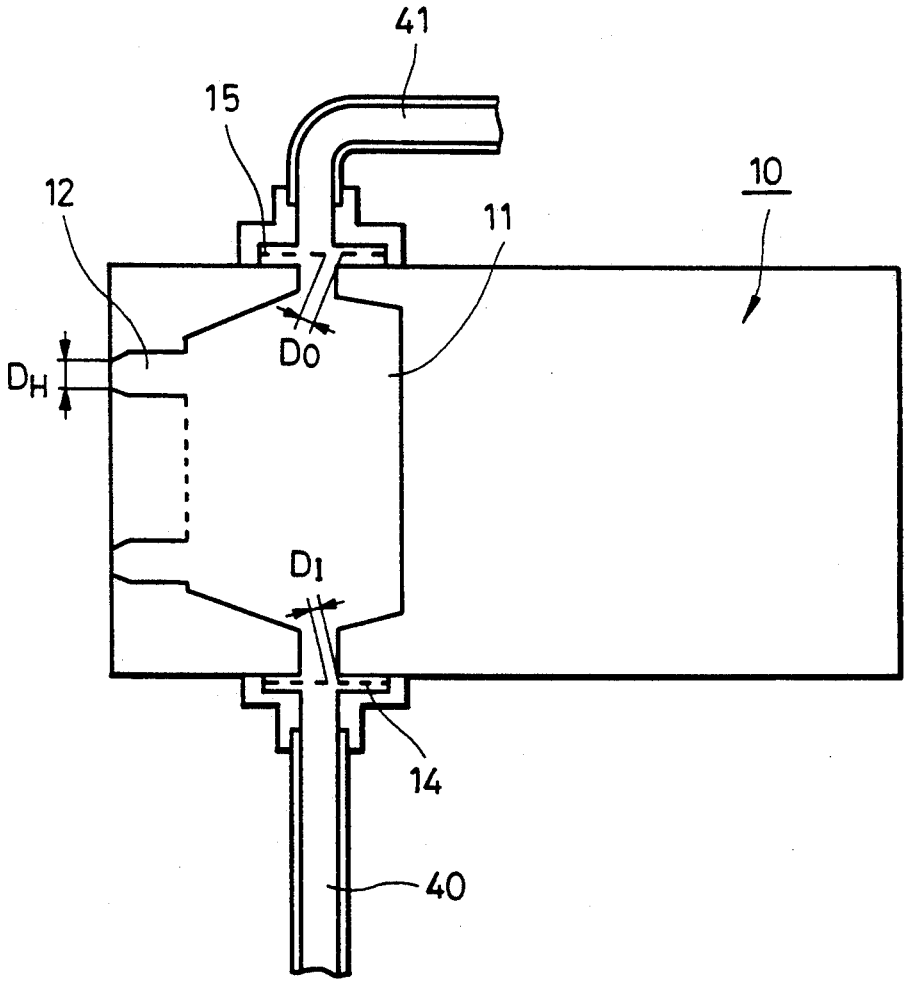
FIG. 1 is a view showing an ink jet recording head of a first embodiment of the present invention.
Figure 2:
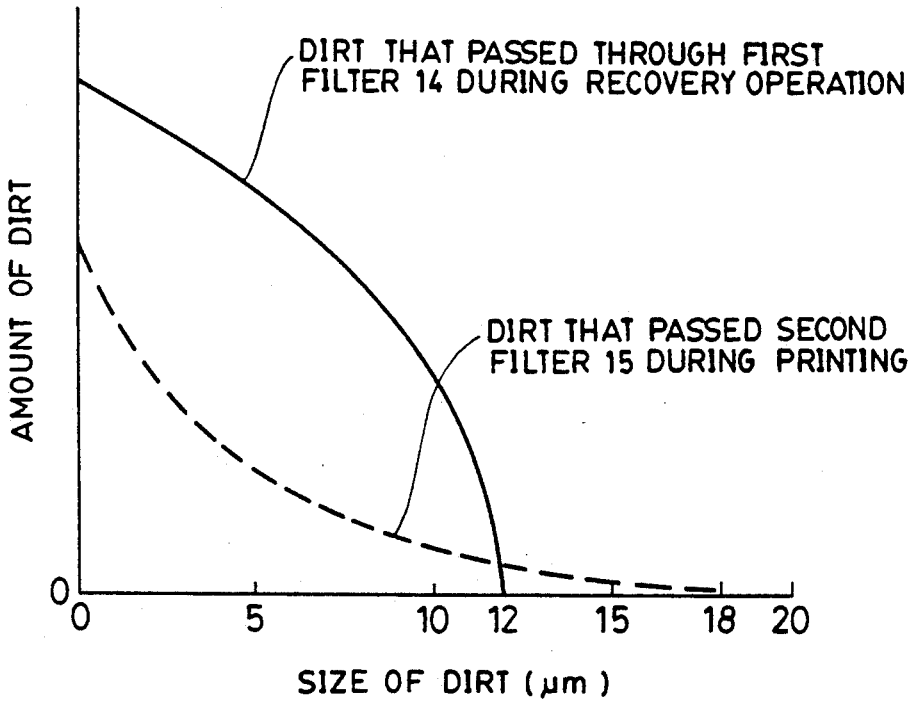
FIG. 2 is a graph showing the relationship between the size and the amount of dirt that passes through a first and and a second filter.

FIG. 1 shows an ink jet recording head 10 in a first embodiment of the present invention. FIG. 2 shows the relationship between the size and the amount of dirt that passes through a first filter 14 and a second filter 15.

The ink jet recording apparatus of this embodiment differs from an ink jet recording apparatus shown in FIG. 7 in the following respects:

(1) The size $D_I$ of the openings of the first filter 14, disposed at the junction of a lower tube 40 and the ink jet recording head 10, is smaller than the size $D_O$ of the openings of the second filter 15.

(2) Both the size $D_I$ of the openings of the first filter 14 and the size $D_O$ of the openings of the second filter 15 are smaller than the minimum diameter $D_H$ of the head nozzle 12.

In the ink jet recording head 10 of this embodiment, the size $D_I$ of the openings of the first filter 14, the size $D_O$ of the openings of the second filter 15, and the minimum diameter $D_H$ of the head nozzle 12 are: $D_I=12$ μm, $D_O=18$ μm, and $D_H=24$ μm.

Shown in FIG. 2 are the results of a recovery operation performed in the above-mentioned embodiment. FIG. 2 measures the relationship between the size and the amount of dirt that passes through the first filter 14 and the second filter 15 when the ink jet recording head 10 is in position for operation in the ink jet recording apparatus.

The amount of dirt that passes through the first filter during the recovery operation, as shown by a solid line in FIG. 2, decreases gradually as the size of dirt particles approaches 10 μm in the section of the line in which the size of dirt is from 0 to 10 μm. When the size of dirt particles becomes 10 μm or larger, the amount of dirt that passes through the first filter 14 decreases sharply as the size of dirt particles becomes larger and dirt particles 12 μm or larger rarely pass through the first filter 14. Regarding dirt in the form of filaments or strings, it would be expected theoretically that filaments of infinite length will pass through the first filter 14. However, in practice only a dirt particle whose length is no longer than its diameter passes through the first filter 14. Furthermore, almost all dirt particles whose size is 12 μm or smaller that pass through the first filter 14 during the recovery operation also pass through the second filter 15, whose opening size $D_O$ is 18 μm, and return to a subtank (not shown in FIG. 1) through the upper tube 41. A portion of the dirt is discharged from the head nozzles 12 whose minimum diameter $D_H$ is 24 μm. Thus, dirt does not stay in the liquid chamber 11.

When recording is performed by an ink jet recording apparatus on which the head 10 is mounted, the amount of dirt that passes through the second filter 15, as shown by a broken line in FIG. 2, decreases exponentially as the size of dirt particles becomes larger. Dirt particles of 18 μm rarely pass through the second filter 15. During printing, as described above, ink is supplied from the upper tube 41, not fed by pressure, and flows slowly by capillary action. Therefore, although theoretically the maximum size of the dirt particles that pass through the second filter 15 is 18 μm, the probability that dirt will pass through the second filter 15 becomes smaller as the size of the dirt particles becomes larger. Almost all dirt that passes through the second filter 15 has a size of 5 μm or smaller. Hence, there is only a small probability that a plurality of dirt filaments will become tangled and obstruct the nozzle 12. The size $D_O$ of the openings of the second filter 15 can be set larger than the size $D_I$ of the openings of the first filter 14. Moreover, even if dirt particle of approximately 18 μm enter the liquid chamber 11 during recording, they are discharged from the head nozzle 12. Thus, the nozzle 12 will not become obstructed.

Figure 7:
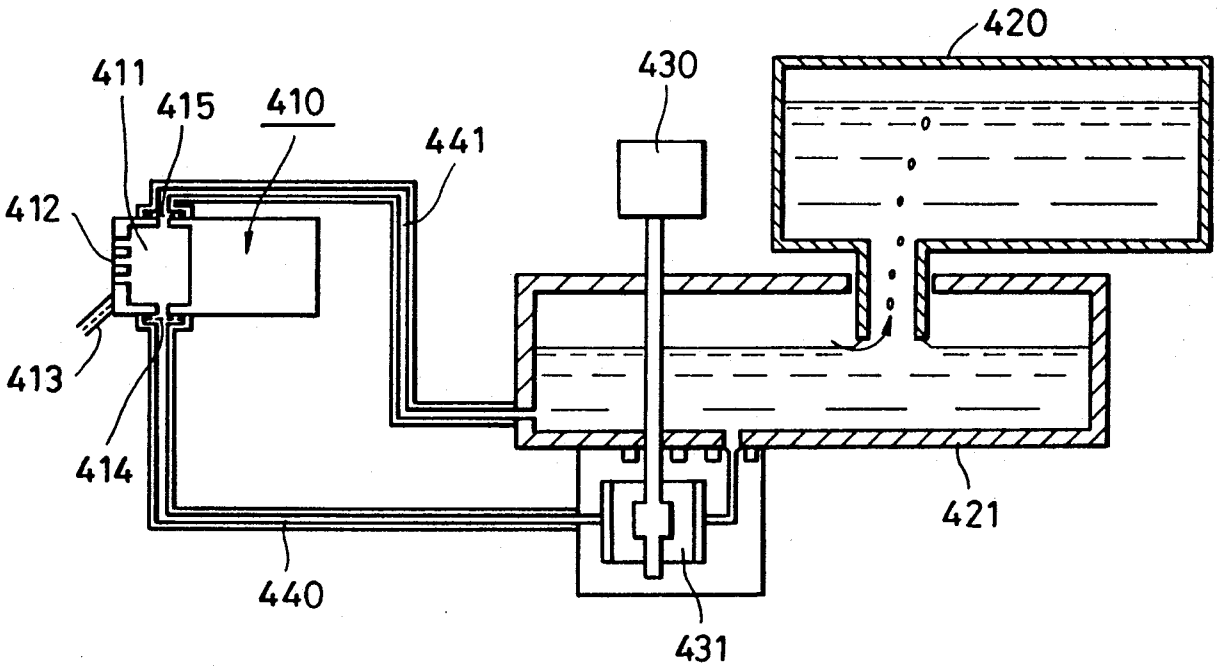
FIG. 7 PRIOR ART
FIG. 7 is a view showing the ink circulation system of a prior art ink jet recording apparatus.

For purposes of comparison, the apparatus shown in FIG. 7, constituted according to the prior art, was made on an experimental basis in which the size of the openings of both the first filter 414 and the second filter 415 was 12 μm. In such a trial apparatus, due to an increase in the loss of pressure caused by the upper tube 441 and the second filter 415, there was a need to enhance the capacity of the gear pump 431. Since it is difficult for dirt particle approximately 12 μm in size that once enter the liquid chamber, to pass through the second filter 415, there have been cases where dirt stays in the liquid chamber 411 for a long period of time. Accordingly, a plurality of dirt particles become tangled, causing the head nozzle 412 to be obstructed. In addition, in a similar trial apparatus with the size of the openings of both the first filter 414 and the second filter 415 being 18 μm, the probability is high that dirt once entering the liquid chamber stays for a long period of time. Since the size of the dirt particle is not much different from the minimum diameter 24 μm of the head nozzle 412, a small amount of dirt becoming tangled can obstruct the head nozzle 412.

Figure 3:
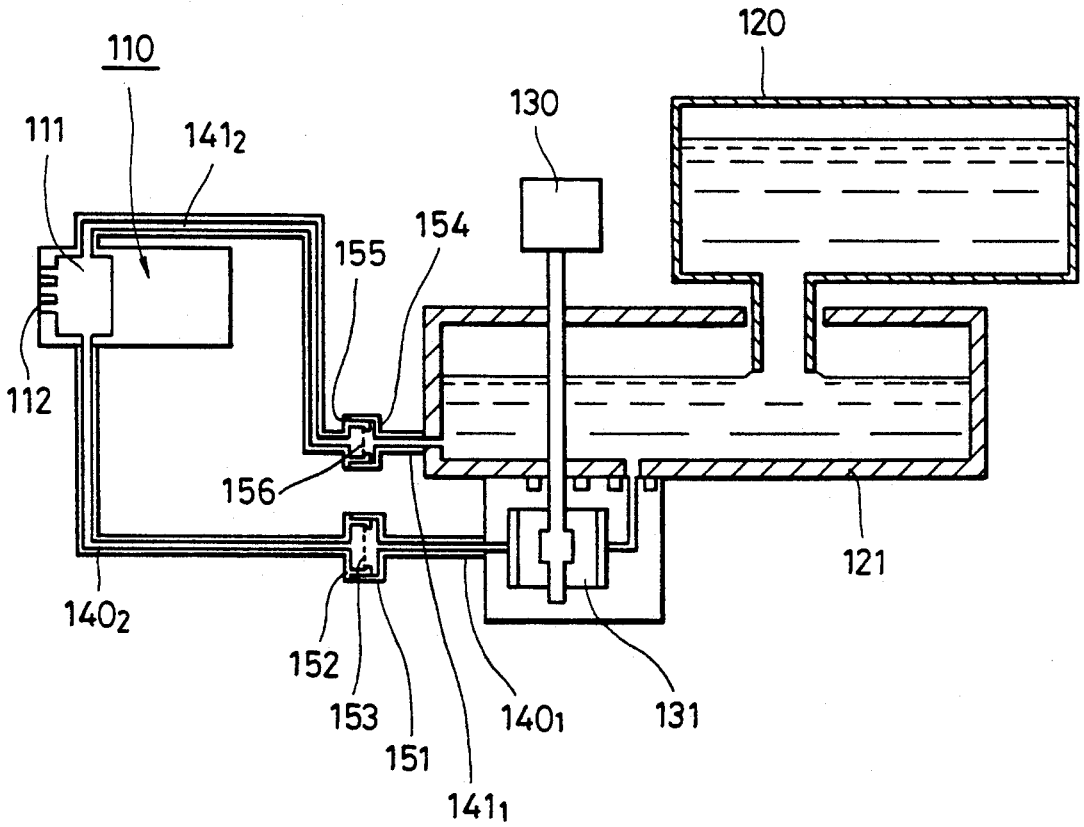
FIG. 3 is a view showing an ink circulation system in a second embodiment of the present invention.

FIG. 3 shows an ink circulation system in a second embodiment of an ink jet recording apparatus of the present invention. As in the previous embodiment, droplets are ejected from nozzles and ink drops by gravity from ink cartridge 120 to subtank ink housing 121.

The ink jet recording apparatus of this embodiment has a first filter 153 disposed between a lower tube section $\mathbf{140}_1$ and a lower tube section $\mathbf{140}_2$ and a second filter 156 disposed between an upper tube section $\mathbf{141}_1$ and an upper tube section $\mathbf{141}_2$.

The lower tube section $\mathbf{140}_1$ connected to the gear pump 131, which is driven by motor 130, and the upper tube section $\mathbf{141}_1$, connected to the subtank 121, have respectively a first female connector 151 and a second female connector 154. The first female connector 151 second female connector 154 are respectively fitted into a first male connector 152 of the lower tube section $\mathbf{140}_2$ connected to liquid chamber 111 of the ink jet recording head 110 and a second male connector 155 of the upper tube section $\mathbf{141}_2$ connected to the liquid chamber 111. To the first male connector 152 and the second male connector 155, the first filter 153 and second filter 156 are respectively fixed.

In this embodiment, the same advantage as in the first embodiment can be obtained by setting the size of the openings of the first filter 153 to 12 μm and the size of the openings of the second filter 156 to 18 μm. The areas of the two filters can be made large by disposing the first filter 153 and the second filter 156 midway in the ink supply path of the ink jet recording head 110. Hence, even if dirt is captured by the two filters and the flow resistance of the two filters is increased gradually, the degree of increase in the overall flow path resistance can be reduced because of the large area of the filters. In addition, the resistances of the two filters can be made equal if the area of the first filter 153, with smaller openings, is larger overall than the area of the openings second filter 156.

Figure 4:
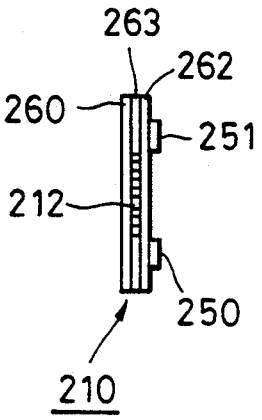
FIG. 4 is a front view showing the structure of an ink jet recording head according to the present invention.
Figure 5:
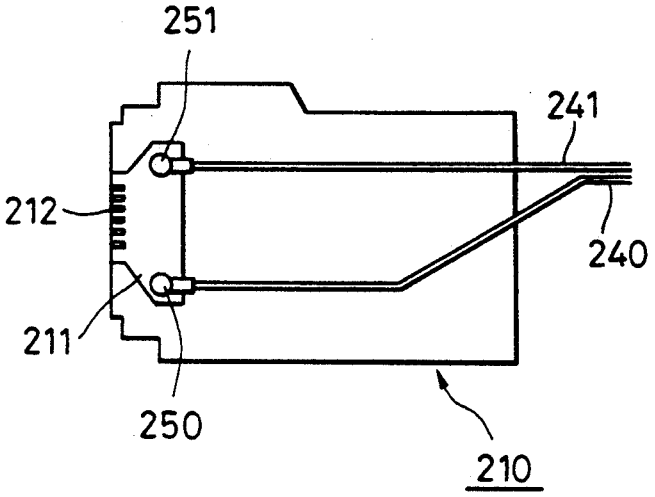
FIG. 5 is a side view of the ink jet recording head shown in FIG. 4.
Figure 6:
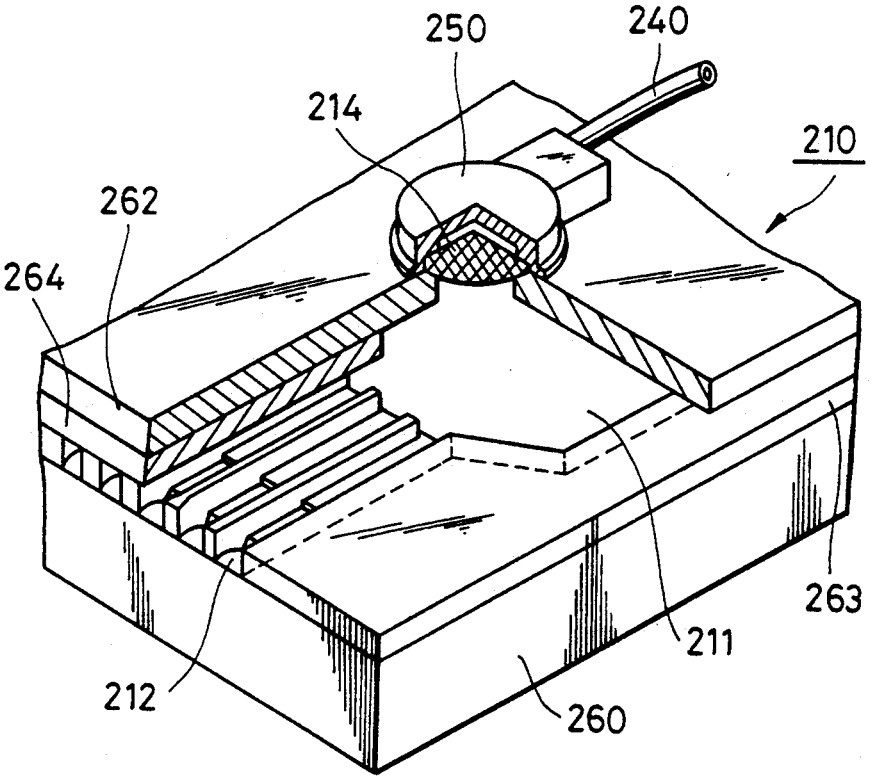
FIG. 6 is a perspective view in which a portion of the side of the ink jet recording head of FIG. 4 is shown in cross section.

FIG. 4 is a front view showing the structure of an ink jet recording head 210 of a third embodiment of the present invention. FIG. 5 is a side view of the ink jet recording head 210 shown in FIG. 4. FIG. 6 is a perspective view in which a portion of the side of the ink jet recording head of FIG. 4 is shown in cross section.

This ink jet recording head 210 differs from that of the ink jet recording head 10 shown in FIG. 1 in that ink is supplied from the side of the head through the lower tube 240 and the upper tube 241.

The ink jet recording head 210 is comprised of an etching layer 263 inserted between a silicon board 260 and a glass cover plate 262, and a plurality of head nozzles 212 are formed in the etching layer 263. As shown in FIG. 5, the lower tube 240 and the upper tube 241 are connected to the liquid chamber 211 of the ink jet recording head 210 by means of a first elbow 250 and a second elbow 251. The structure of this ink jet recording head 210 will be explained in more detail with reference to FIG. 6. In the ink jet recording head 210, a plurality of head nozzles 212 are formed on the board 260 by the use of the etching layer 263, and the etching layer 263 and the glass plate 262 are attached to a bonding layer 264. Thus, a thinner ink jet recording head 210 is achieved. The first elbow 250 guides the ink supplied by way of the lower tube 240 to the liquid chamber 211 and presses the first filter 214 in place. The same is true of the second elbow 251 with respect to the upper tube 241 and the second filter (not shown in FIG. 6).

The same advantage as the first embodiment can be obtained also with this ink jet recording head 210 by setting the size of the opening of the first filter 214 to 12 μm and the size of the openings of the second filter (not shown), which is pressed in place by second elbow 251, to 18 μm.

In the ink jet recording head 210, the first filter 214 and the second filter may be bonded beforehand to the glass plate 262.

Both the ink jet recording head 10 shown in FIG. 1 and the ink jet recording head 210 shown in FIG. 4 have a first and a second filter. Therefore, even if the two filters have gradually, become obstructed with dirt during use, the dirt is removed by the replacement of the head and the resistance of the flow path of the ink jet recording apparatus as a whole will not increase indefinitely.

Excellent advantages can be obtained with the present invention when incorporating an ink jet recording head and an ink jet recording apparatus that includes means (for example, an electrothermal converter, a laser beam, etc.) for generating thermal energy used for discharging ink and that discharges ink by causing the ink to transform its state by means of the thermal energy.

Typical structure and principles of such, an apparatus are disclosed, for instance, in U.S. Pat. No. 4,723,129. Such structure and principle can be used in both so-called on-demand type and continuous type recording apparatus. In the case of the on-demand type particularly, thermal energy is generated in an electrothermal converter in a liquid path by applying at least one drive signal which causes a sudden increase in temperature, that exceeds the nucleate boiling point of liquid ink in the liquid path. This film boiling is caused on the thermal working surface of the electrothermal converter of the ink jet recording head. As a result, vapor bubbles can be formed in the liquid (ink) in a one-to-one correspondence with a drive signal corresponding to recording information. The liquid (ink) is discharged through the head nozzle by the growth and contraction of this bubble in order to form at least one liquid drop to be deposited on a recording medium. If the drive signal is in the form of pulses, bubbles are grown or contracted properly in an instantaneous manner and discharging of ink can be achieved with excellent response. Suitable drive signals are described in U.S. Pat. Nos. 4,463,359 and 4,345,262. In addition, the adoption of conditions described in U.S. Pat. No. 4,313,124, which relates to the growth properties of the bubble formed on the thermal working surface described above, provides excellent recording.

Such an ink jet recording head may be comprised of a combination of a discharge outlet (nozzle), liquid path, and an electrothermal converter arranged in a straight line liquid path, as disclosed in the above-identified patents. It may also be comprised of structure such as that described in U.S. Pat. Nos. 4,558,333 and 4,459,600, in which a thermal working section is placed in an area of the liquid path that bends. In addition, the present invention is also effective if it is constructed on the basis of Japanese Unexamined Patent Publication No. 59-123670, which discloses an arrangement where common slits comprises discharge outlets for a plurality of electrothermal converters, or Japanese Unexamined Patent Publication No. 59-138461, which discloses an arrangement where openings that absorb thermal energy pressure waves are made to correspond to discharge outlets for a plurality of electrothermal converters.

A full-line type ink jet recording head is one having a plurality of nozzles extending a length corresponding to the full width of the maximum recording medium, so that the ink jet recording apparatus can record the entire width of the recording medium simultaneously. Such a head may be an arrangement which attains the necessary length by a combination of a plurality of ink jet recording heads as disclosed in U.S. Pat. No. 4,463,359, or an ink jet recording head which is formed in one piece. The present invention can attain the advantages of such arrangements more effectively.

The present invention is also effective in a replaceable chip type ink jet recording head incorporating the filters 14 and 15, the loading of which head onto the apparatus main body permits an electrical connection with the apparatus main body and the supply of ink from the apparatus main body, or in a cartridge type in jet recording head with an ink cartridge integrally disposed in the ink jet recording head itself.

The addition of a recovery means and a spare auxiliary means, which may be provided as components of the ink jet recording apparatus of the present invention, to the ink jet recording head provides an apparatus incorporating the present invention with still more advantages. That is, the present invention may be used with a capping means, a cleaning means, a pressing or suction means, a preparatory heating means which is an electrothermal converter, or a heating element which is different from the electrothermal converter, or a combination of such features. Performing a preparatory discharge mode in which discharging is performed separately from recording is also effective to provide stable recording.

The ink jet recording apparatus of the present invention can record using a main color such as black. An arrangement in which the ink jet recording head of the present invention is constructed in one piece or a combination of two or more heads may be used in an apparatus that records using at least one of several different colors or that performs full-color recording using mixed colors.

In the embodiments of the present invention described above, liquid ink is used. However, ink that solidifies at room temperature or below and that softens or liquefies at room temperature, or ink that softens or liquefies at temperatures between 30° C. and 70° C., which is the range of temperature adjustment performed generally in such apparatus, may be used. That is, ink that liquefies when a recording signal is applied to an electrothermal converter may be used. In addition, ink that liquefies for the first time when thermal energy is applied to it may be used. For example, ink that liquefies and is discharged in the form of liquid by application of thermal energy corresponding to a recording signal may be used and such ink will begin to solidify when it reaches the recording medium because its temperature is kept to a minimum by using mode of the thermal energy for as energy for transforming the ink from a solid to a liquid. In addition, ink that solidifies when left along will not evaporate. The present invention may be used in apparatus in which the ink opposes the electrothermal converter as a liquid or solid matter in a porous sheet recess or a through hole, as described in Japanese Unexamined Patent Publication Nos. 54-56847 and 60-71260. In the present invention, the most effective embodiment for any of the above-described inks is one in which ejection is performed film boiling.

Since the embodiments of the present invention are constructed as described above, they have the following advantages.

The size $D_I$ of the openings of the first filter disposed at any position in the first ink path which supplies ink to an ink jet recording head during a recovery operation is set smaller than the size $D_O$ of the openings of the second filter disposed at any position in the second ink path which supplies ink to the ink jet recording head during printing or recording. As a result, it is difficult for dirt to enter the liquid chamber, while dirt that does enter the liquid chamber goes out of the liquid chamber after passing through the second filter. Therefore, the present invention has an advantage in that dirt can be prevented from staying in the liquid chamber for a long period of time. Since the dirt that enters the liquid chamber can be discharged from the head nozzle, because the minimum diameter $D_H$ of the head nozzle is larger than the size $D_I$ of the openings of the first filter, such dirt can be prevented from staying in the liquid chamber for a long period of time.

As has been explained above in detail, the present invention may provide an ink jet recording apparatus in which obstruction of the head nozzle is minimized.

Many different embodiments of the present invention can be made without departing from the spirit and scope thereof; therefore, it is to be understood that this invention is not limited to the specific embodiments described above and is solely defined in the appended claims.

What is claimed is:

1. An ink jet recording head comprising:

an outlet for discharging ink onto a recording medium;

a liquid chamber for storing ink to be discharged from said outlet;

a first filter disposed in a first flow path in communication with said liquid chamber at a first location, said first filter having filter openings for ink flowing in said first flow path to said liquid chamber for a recovering operation of the recording head; and a second filter disposed in a second flow path in communication with said liquid chamber at a second location different from said first location, said second filter in the second flow path having filter openings for ink flowing to said liquid chamber for discharge from said outlet onto the recording medium and for ink flowing from said liquid chamber during the recovering operation, wherein a size $D_I$ of said openings of said first filter, a size $D_O$ of said openings of said second filter and a minimum diameter $D_H$ of said outlet, have a relationship $D_I < D_O < D_H$.

2. An ink jet head recording head according to claim 1, having a plurality of said outlets.

3. An ink jet head recording head according to claim 2, wherein said outlets are arranged for simultaneously recording on a full width of the recording medium.

4. An ink jet head recording head according to claim 1, further including an electrothermal converting member for generating heat energy used to discharge ink from said outlet.

5. An ink jet head recording head according to claim 4, wherein said electrothermal converting member causes film boiling of ink in a liquid path between said liquid chamber and said outlet to generate a bubble in the ink in said liquid path to discharge ink from said outlet.

6. An ink jet head recording head according to claim 1, comprising a base plate and a cover plate, said liquid chamber being provided by a space between said base plate and said cover plate, wherein said first and second flow paths comprise openings in said cover plate.

7. An ink jet head recording head according to claim 1, wherein $D_I$ is 12 μm, $D_O$ is 18 μm and $D_H$ is 24 μm.

8. An ink jet head recording head according to claim 1, wherein said first and second filters each have an area exposed to said respective flow paths where said first and second filters expose different areas to said respective flow paths, the area exposed by said first filter being larger than the area exposed by said second filter.

9. An ink jet recording apparatus for recording on a recording medium by discharging ink from an outlet of an ink jet recording head, the apparatus comprising:

an ink housing for storing ink;

a first ink path communicating with said ink housing and said ink jet recording head to supply ink to said recording head at a first location for a recovering operation thereof;

a first filter disposed in said first ink path and having filter openings for ink flowing in said first ink path;

a second ink path at a second location different from said first location communicating with said ink housing and said ink jet recording head to supply ink to said ink jet recording head for discharge from said outlet for recording and to allow ink to flow from said ink jet recording head to said ink housing during the recovering operation, a second filter disposed in said second ink path and having filter openings for ink flowing in said second ink path, wherein a size $D_I$ of said openings of said first filter, a size $D_O$ of said openings of said second filter and a minimum diameter $D_H$ of said outlet, have a relationship $D_I < D_O < D_H$.

10. An ink jet recording apparatus according to claim 9, wherein said recording head includes a plurality of said outlets.

11. An ink jet recording apparatus according to claim 10, wherein said outlets are arranged for simultaneously recording on a full width of the recording medium.

12. An ink jet recording apparatus according to claim 9, further comprising a pump for supplying ink under pressure from said ink housing to said recording head through said first flow path, and returning ink to said ink housing from said recording head through said second flow path to recover operation of said recording head.

13. An ink jet recording apparatus according to claim 12, wherein said pump is disposed in said first flow path and ink for recording is supplied from said ink housing to said recording head by capillary action through said second flow path.

* * * * *

UNITED STATES PATENT AND TRADEMARK OFFICE

CERTIFICATE OF CORRECTION

PATENT NO. : 5,296,875

DATED : March 22, 1994

INVENTOR(S) : MASASHI SUDA

It is certified that error appears in the above-identified patent and that said Letters Patent is hereby corrected as shown below:

COLUMN 2

Line 32, "probability" should read --probability of--.

COLUMN 3

Line 16, "and and" should read --and--.
Line 42, "recording" should read --recording.--.

COLUMN 4

Line 52, "particle" should read --particles--.
Line 64, "particle" should read --particles--.

COLUMN 5

Line 46, "openings" should read --openings of the--.

COLUMN 6

Line 21, "gradually," should read --gradually--.
Line 33, "such," should read --such--.

COLUMN 7

Line 3, "comprises" should read --comprise--.
Line 26, "in jet" should read --ink jet--.
Line 66, "mode" should read --much--.
Line 67, "for" should be deleted.

COLUMN 8

Line 1, "along" should read --alone--.

UNITED STATES PATENT AND TRADEMARK OFFICE

CERTIFICATE OF CORRECTION

PATENT NO. : 5,296,875

DATED : March 22, 1994

INVENTOR(S) : MASASHI SUDA

It is certified that error appears in the above-identified patent and that said Letters Patent is hereby corrected as shown below:

COLUMN 8

Line 8, "performed" should read --performed by--.
Line 64, "head recording head" should read --recording head--.
Line 66, "head recording head" should read --recording head--.

COLUMN 9

Line 1, "head recording head" should read --recording head-
Line 5, "head recording head" should read --recording head-
Line 11, "head recording head" should read --recording head--.
Line 16, "head recording head" should read --recording head--.
Line 18, "head recording head" should read --recording head--.

Signed and Sealed this

Thirteenth Day of September, 1994

Bruce Lehman

*Attest:*

BRUCE LEHMAN

*Attesting Officer*

*Commissioner of Patents and Trademarks*